US009706324B2

(12) United States Patent
Vilermo et al.

(10) Patent No.: US 9,706,324 B2
(45) Date of Patent: Jul. 11, 2017

(54) SPATIAL OBJECT ORIENTED AUDIO APPARATUS

(71) Applicant: Nokia Technologies Oy, Espoo (FI)

(72) Inventors: Miikka Tapani Vilermo, Siuro (FI); Toni Makinen, Pirkkala (FI); Adriana Vasilache, Tampere (FI); Roope Olavi Jarvinen, Lempäälä (FI); Lasse Juhani Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/890,449

(22) PCT Filed: May 17, 2013

(86) PCT No.: PCT/IB2013/054044

§ 371 (c)(1),
(2) Date: Nov. 11, 2015

(87) PCT Pub. No.: WO2014/184618

PCT Pub. Date: Nov. 20, 2014

(65) Prior Publication Data

US 2016/0119733 A1 Apr. 28, 2016

(51) Int. Cl.
*H04R 5/00* (2006.01)
*H04S 5/00* (2006.01)
(Continued)

(52) U.S. Cl.
CPC ..... *H04S 5/00* (2013.01); *G10L 25/03* (2013.01); *G10L 25/21* (2013.01); *H04S 1/007* (2013.01);
(Continued)

(58) Field of Classification Search
CPC ..... G10L 19/008; G10L 19/20; G10L 19/167; G10L 19/038; G10L 19/0017;
(Continued)

(56) References Cited

U.S. PATENT DOCUMENTS 5,661,808 A 8/1997 Klayman
6,446,037 B1 9/2002 Fielder et al.
(Continued)

FOREIGN PATENT DOCUMENTS

EP 2154910 A1 2/2010
EP 2445234 4/2012
(Continued)

OTHER PUBLICATIONS

International Search Report and Written Opinion received for corresponding Patent Cooperation Treaty Application No. PCT/IB2013/054044, dated Apr. 15, 2014, 14 pages.
(Continued)

*Primary Examiner* — Paul S Kim
*Assistant Examiner* — Norman Yu
(74) *Attorney, Agent, or Firm* — Nokia Technologies Oy

(57) ABSTRACT

An apparatus comprising: a perception sorter configured to perceptually order at least two object orientated audio signal channels; and a selective channel processor configured to process at least one of the at least two object orientated audio signal channels based on the order of the at least two object orientated audio signal channels.

18 Claims, 9 Drawing Sheets

(51) Int. Cl.

| | |
|---|---|
| ***G10L 25/03*** | (2013.01) |
| ***G10L 25/21*** | (2013.01) |
| ***H04S 1/00*** | (2006.01) |
| *H04R 29/00* | (2006.01) |
| *G10L 19/008* | (2013.01) |

(52) U.S. Cl.
CPC ..... *G10L 19/008* (2013.01); *H04S 2400/03* (2013.01); *H04S 2400/11* (2013.01)

(58) Field of Classification Search
CPC ..... G10L 21/028; G10L 21/0364; H04S 2400/03; H04S 3/008; H04S 2400/11; H04S 2400/01; H04S 5/005; H04S 2420/11; H04S 2400/15; H04R 5/04; H04R 5/02; H04R 2201/401; H04R 29/00
USPC ... 381/22–23, 17, 303, 307, 18, 1, 103, 119, 381/56, 98
See application file for complete search history.

(56) References Cited

U.S. PATENT DOCUMENTS

| | | | | |
|---|---|---|---|---|
| 7,706,543 | B2 | 4/2010 | Daniel | |
| 8,023,660 | B2 | 9/2011 | Faller | |
| 8,280,077 | B2 | 10/2012 | Avendano et al. | |
| 8,335,321 | B2 | 12/2012 | Daishin et al. | |
| RE44,611 | E | 11/2013 | Metcalf | |
| 8,600,530 | B2 | 12/2013 | Nagle et al. | |
| 8,861,739 | B2 | 10/2014 | Ojanpera | |
| 2003/0161479 | A1 | 8/2003 | Yang et al. | |
| 2005/0008170 | A1 | 1/2005 | Pfaffinger et al. | |
| 2005/0195990 | A1 | 9/2005 | Kondo et al. | |
| 2005/0244023 | A1 | 11/2005 | Roeck et al. | |
| 2008/0008326 | A1* | 1/2008 | Reichelt ..... | H04R 1/403 381/17 |
| 2008/0013751 | A1 | 1/2008 | Hiselius | |
| 2008/0232601 | A1 | 9/2008 | Pulkki | |
| 2009/0012779 | A1 | 1/2009 | Ikeda et al. | |
| 2009/0022328 | A1 | 1/2009 | Neugebauer et al. | |
| 2010/0061558 | A1 | 3/2010 | Faller | |
| 2010/0150364 | A1 | 6/2010 | Buck et al. | |
| 2010/0166191 | A1 | 7/2010 | Herre et al. | |
| 2010/0215199 | A1 | 8/2010 | Breebaart | |
| 2010/0284551 | A1 | 11/2010 | Oh et al. | |
| 2010/0290629 | A1 | 11/2010 | Morii | |
| 2011/0038485 | A1 | 2/2011 | Neoran | |
| 2011/0081024 | A1 | 4/2011 | Soulodre | |
| 2011/0299702 | A1 | 12/2011 | Faller | |
| 2012/0013768 | A1 | 1/2012 | Zurek et al. | |
| 2012/0019689 | A1 | 1/2012 | Zurek et al. | |
| 2012/0063604 | A1 | 3/2012 | Myburg et al. | |
| 2012/0183148 | A1 | 7/2012 | Cho et al. | |
| 2012/0230497 | A1 | 9/2012 | Dressler et al. | |

FOREIGN PATENT DOCUMENTS

| | | | |
|---|---|---|---|
| JP | 2006-180039 | A | 7/2006 |
| JP | 2009-271183 | A | 11/2009 |
| WO | 2005/086139 | A1 | 9/2005 |
| WO | 2007/011157 | A1 | 1/2007 |
| WO | 2007052088 | | 5/2007 |
| WO | 2008/018689 | A1 | 2/2008 |
| WO | 2008/046531 | A1 | 4/2008 |
| WO | 2009001292 | | 12/2008 |
| WO | 2009/150288 | A1 | 12/2009 |
| WO | 2010/017833 | A1 | 2/2010 |
| WO | 2010/028784 | A1 | 3/2010 |
| WO | 2010/125228 | A1 | 11/2010 |
| WO | 2011/020065 | A1 | 2/2011 |
| WO | 2011114192 | | 9/2011 |
| WO | 2013/006338 | A2 | 1/2013 |
| WO | 2014/099285 | A1 | 6/2014 |

OTHER PUBLICATIONS

Rd J. et al. "Spatial Audio Object Coding (SAOC)—Te Upcoming MPEG Standard on Parametric Object Based Audio Coding", 124th AS Convention, Audio Engineering Society, Paper 7377, 20080517.
Laitinen et al., "Binaural Reproduction for Directional Audio Coding", IEEE Workshop on Applications of Signal Processing to Audio and Acoustics, Oct. 18-21, 2009, pp. 337-340.
Gerzon, "Ambisonics in Multichannel Broadcasting and Video", 74th AES Convention, Oct. 8-12, 1983, pp. 1-31.
Backman, "Microphone Array Beam Forming for Multichannel Recording", 114th AES Convention, Mar. 22-25, 2003, pp. 1-7.
Merimaa, "Applications of a 3-d Microphone Array", AES 112th Convention, May 10-13, 2002, pp. 1-11.
Meyer et al., "Spherical Microphone Array for Spatial Sound Recording", AES 115th Convention, Oct. 10-13, 2003, pp. 1-9.
Wiggins, "An Investigation Into the Real-time Manipulation and Control of Threedimensional Sound Fields", Thesis, 2004, 370 Pages.
Gallo et al., "Extracting and Re-rendering Structured Auditory Scenes From Field Recordings", AES 30th International Conference, Mar. 15-17, 2007, pp. 1-11.
Goodwin et al., "Binaural 3-d Audio Rendering Based on Spatial Audio Scene Coding", 123rd AES Convention, Oct. 5-8, 2007, pp. 1-12.
Lindblom et al., "Flexible Sum-Difference Stereo Coding Based on Time-aligned Signal Components", IEEE Workshop an Applications of Signal Processing to Audio and Acoustics, Oct. 16-19, 2005, pp. 255-258.
Pulkki, "Spatial Sound Reproduction With Directional Audio Coding", Journal of the Audio Engineering Society, vol. 55, No. 6, Jun. 2007, pp. 503-516.
Vilkamo et al., "Directional Audio Coding: Virtual Microphone-based Synthesis and Subjective Evaluation", Journal of the Audio Engineering Society, vol. 57, No. 9, Sep. 2009, pp. 709-724.
Tamai et al., "Real-time 2 Dimensional Sound Source Localization by 128-channel Huge Microphone Array", 13th IEEE International Workshop on Robot and Human Interactive Communication, Sep. 20-22, 2004, pp. 65-70.
Nakadai et al., "Sound Source Tracking With Directivity Pattern Estimation Using a 64 Ch Microphone Array", IEEE/RSJ International Conference on Intelligent Robots and Systems, Aug. 2-6, 2005, 7 Pages.
Kallinger et al., "Enhanced Direction Estimation Using Microphone Arrays for Directional Audio Coding", Hands-Free Speech Communication and Microphone Arrays, May 6-8, 2008, pp. 45-48.
Ahonen et al., "Directional Analysis of Sound Field With Linear Microphone Array and Applications in Sound Reproduction", 124th AES Convention, May 17-20, 2008, pp. 1-11.
Baumgarte et al., "Binaural Cue Coding—Part I: Psychoacoustic Fundamentals and Design Principles", IEEE Transactions on Speech and Audio Processing, vol. 11, No. 6, Nov. 2003, pp. 509-519.
Faller et al., "Binaural Cue Coding—Part II: Schemes and Applications", IEEE Transactions on Speech and Audio Processing, vol. 11, No. 6, Nov. 2003, pp. 520-531.
"Stereophonic Sound", Wikipedia, Retrieved on Jan. 20, 2017, Webpage available at : https://en.wikipedia.org/wiki/Stereophonic_sound#M.2FS_technique:_Mid.2FSide_stereophony.
"Joint (Audio Engineering)", Wikipedia, Retrieved on Jan. 20, 2017, Webpage available at : https://en.wikipedia.org/wiki/Joint_%28audio_engineering%29#M.2FS_stereo_coding.
Pulkki et al., "Directional Audio Coding—Perception-based Reproduction of Spatial Sound", International Workshop on the Principles and Applications of Spatial Hearing, Nov. 11-13, 2009, 4 Pages.
Herre et al., "MPEG Surround—The ISO/MPEG Standard for Efficient and Compatible Multichannel Audio Coding", Joint Audio Engineering Society, vol. 56, No. 11, Nov. 2008, pp. 932-955.
"Information technology—MPEG audio technologies—Part 1: MPEG Surround", ISO/IEC 23003-1, 2007, pp. 1-12.

(56) References Cited

OTHER PUBLICATIONS

Fielder et al., "Introduction to Dolby Digital Plus, an Enhancement to the Dolby Digital Coding System", 117th Audio Engineering Society Convention, Oct. 28-31, 2004, pp. 1-29.
Kassier et al., "An Informal Comparison Between Surround-Sound Microphone Techniques", 118th Audio Engineering Society Convention, May 28-31, 2005, pp. 1-17.
Hiekkanen et al., "Reproduction of Virtual Reality with Multichannel Microphone Techniques", 122nd Audio Engineering Society Convention, May 5-8, 2007, pp. 1-7.
Craven, "Continuous Surround Panning For 5-speaker Reproduction", AES 24th International Conference: Multichannel Audio, Jun. 1, 2003, pp. 1-6.
U.S. Appl. No. 13/209,738, "Apparatus and Method for Multichannel Signal Playback", filed Aug. 15, 2011, 32 pages.
Pulkki, "Virtual Sound Source Positioning Using Vector Base Amplitude Panning", Audio Engineering Society (AES), vol. 45, No. 6, Jun. 1, 1997, pp. 456-466.
Irwan et al., "A Method to Convert Stereo to Multi-channel Sound", AES 19th International Conference, Jun. 21-24, 2001, pp. 1-5.
"U.S. Appl. No. 12/927,663, ""Converting Multi-Microphone Captured Signals to Shiftedsignals Useful for Binaural Signal Processing and Use Thereof"", filed Nov. 19, 2010, 22 pages."
Blumlein, "Improvements in and relating to Sound-transmission, Sound-recording and Sound-reproducing Systems", British Patent Specification 394,325, Dec. 14, 1931, pp. 32-40.
International Search Report and Written Opinion received for corresponding Patent Cooperation Treaty Application No. PCT/FI2011/050861, dated Feb. 24, 2012, 13 pages.
Knapp et al., "The Generalized Correlation Method For Estimation of Time Delay", IEEE Transactions on Acoustics, Speech, and Signal Processing, vol. 24, No. 4, Aug. 1976, pp. 320-327.
"My Week of Audio: Part 2—Dolby Atmos", The Bonus View, Retrieved on Dec. 15, 2016, Webpage available at : http://www.highdefdigest.com/blog/dolby-atmos/.
International Search Report and Written Opinion received for corresponding Patent Cooperation Treaty Application No. PCT/FI2012/050763, dated Feb. 4, 2013, 11 pages.
Non-Final Office action received for corresponding U.S. Appl. No. 12/927,663, dated May 3, 2013, 12 pages.
Non-Final Office action received for corresponding U.S. Appl. No. 13/209,738, dated Oct. 7, 2013, 16 pages.
Final Office action received for corresponding U.S. Appl. No. 12/927,663, dated Nov. 20, 2013, 11 pages.
Non-Final Office action received for corresponding U.S. Appl. No. 12/927,663, dated Mar. 27, 2014, 11 pages.
Final Office action received for corresponding U.S. Appl. No. 13/209,738, dated Apr. 1, 2014, 16 pages.
Final Office action received for corresponding U.S. Appl. No. 12/927,663, dated Oct. 23, 2014, 13 pages.
Non-Final Office action received for corresponding U.S. Appl. No. 13/209,738, dated Nov. 24, 2014, 18 pages.
Extended European Search Report received for corresponding European Patent Application No. 11840946.5, dated Feb. 24, 2015, 9 pages.
Breebaart et al., "Multi-channel Goes Mobile: MPEG Surround Binaural Rendering", AES 29th International Conference, Sep. 2-4, 2006, pp. 1-13.
Tellakula, "Acoustic Source Localization Using Time Delay Estimation", Thesis, Aug. 2007, 82 Pages.
Non-Final Office action received for corresponding U.S. Appl. No. 12/927,663, dated Apr. 1, 2015, 16 pages.
Final Office action received for corresponding U.S. Appl. No. 13/209,738, dated Jul. 16, 2015, 20 pages.
Office action received for corresponding European Patent Application No. 11840946.5, dated Mar. 3, 2016, 5 pages.
Office action received for corresponding European Patent Application No. 11840946.5, dated Nov. 17, 2016, 6 pages.
"Matlab", Wikipedia, Retrieved on Jan. 20, 2017, Webpage available at : https://en.wikipedia.org/wiki/MATLAB.
Extended European Search Report received for corresponding European Patent Application No. 13884465.9, dated Dec. 19, 2016, 8 pages.

* cited by examiner

SPATIAL OBJECT ORIENTED AUDIO APPARATUS

RELATED APPLICATION

This application was originally filed as PCT Application No. PCT/IB2013/054044 filed May 17, 2013.

FIELD

The present application relates to apparatus for spatial object oriented audio signal processing. The invention further relates to, but is not limited to, apparatus for spatial object oriented audio signal processing within mobile devices.

BACKGROUND

Spatial audio signals are being used in greater frequency to produce a more immersive audio experience. A stereo or multi-channel recording can be passed from the recording or capture apparatus to a listening apparatus and replayed using a suitable multi-channel output such as a pair of headphones, headset, multi-channel loudspeaker arrangement etc.

Object oriented audio formats represent audio as separate tracks with trajectories. The trajectories contain the directions from which the audio on the track should sound to be coming from during playback. These trajectories are typically expressed with polar coordinates, where the polar angle and azimuth provide the direction.

Several object oriented audio formats have been presented, e.g. Dolby Atmos, MPEG SAOC. Object oriented audio formats have several benefits. For the consumer the most important benefit is the ability to play back the audio using any equipment and still achieve improved audio quality unlike when fixed 5.1 multichannel audio signals are downmixed or the like are used on playback equipment which has fewer channels than the audio signals or when fixed 5.1 multichannel audio signals are upmixed or the like are used on playback equipment which has more channels than the audio signals. The playback equipment can for example be headphones, 5.1 surround in a home theatre apparatus, mono/stereo speakers in a television or a mobile device.

However it would be understood that such object oriented representations can be problematic. The format known as Dolby Atmos can use up to 200 individual channels. Due to data transfer and computational limitations, attempting to transmit store or render 200 channels can impose a significant bandwidth and processing load. This bandwidth and processing load can be significant for mobile devices requiring additional processing capacity with cost and power usage disadvantages. Furthermore a fixed 5.1 downmix would lose all the benefits from an object oriented audio format, such as high quality with any loudspeaker or headphone setup and the possibility to play back audio from above or below.

SUMMARY

Aspects of this application thus provide object oriented audio format reproduction without the high bandwidth or processing capacity requirements.

According to a first aspect there is provided an apparatus comprising at least one processor and at least one memory including computer code for one or more programs, the at least one memory and the computer code configured to with the at least one processor cause the apparatus to at least: perceptually order at least two object orientated audio signal channels; and process at least one of the at least two object orientated audio signal channels based on the order of the at least two object orientated audio signal channels.

Perceptually ordering at least two object orientated audio signal channels may further cause the apparatus to: determine a perception value for each of the at least two object orientated signal channels; and perceptually order the at least two object orientated audio signal channels based on the perception value.

Determining a perception value for each of the at least two object orientated signal channels may cause the apparatus to determine a perception value based on the distance difference between the channel and a defined position.

The defined position may be a nearest of a set of speaker positions.

The set of speaker positions in polar co-ordinates may be $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

Determining a perception value for each of the at least two object orientated signal channels may cause the apparatus to: divide each of the at least two object orientated signal channels into time parts; determine for each time part of the at least two object orientated signal channel $C_x$ the following value:

$$perce(X) = \begin{cases} \frac{\|C_X\| - \|C_{MIN}\|}{\|C_{MAX}\| - \|C_{MIN}\|} \frac{\delta_X}{90^\circ}, & \|C_{MAX}\| \neq \|C_{MIN}\| \\ \frac{\delta_X}{90^\circ}, & \|C_{MAX}\| = \|C_{MIN}\| \end{cases}$$

where $\|C_x\|$ is the energy level of the channel $C_x$, $\|C_{max}\|$ the maximum energy level of the at least two channels at the time part, $\|C_{min}\|$ the minimum energy level of the at least two channels at the time part, and $\delta_x$ is the angular distance for the channel $C_x$ to a nearest of a set of speakers.

Determining a perception value for each of the at least two object orientated signal channels may cause the apparatus to: divide each of the at least two object orientated signal channels into time-frequency parts; determine for each time-frequency part of the at least two object orientated signal channel $C_x$ the following value:

$$perce(C_{X,b}) = \begin{cases} \frac{\|C_{X,b}\| - \|C_{MIN,b}\|}{\|C_{MAX,b}\| - \|C_{MIN,b}\|} \frac{\delta_X}{90^\circ}, & \|C_{MAX,b}\| \neq \|C_{MIN,b}\| \\ \frac{\delta_X}{90^\circ}, & \|C_{MAX,b}\| = \|C_{MIN,b}\| \end{cases}$$

where $\|C_{x,b}\|$ is the energy level of the channel for frequency band $C_x$, $\|C_{max,b}\|$ the maximum energy level of the at least two channels at the time frequency part, $\|C_{min,b}\|$ the minimum energy level of the at least two channels at the time frequency part, and $\delta_x$ is the angular distance for the channel $C_x$ to a nearest of a set of speakers.

The value of $\delta_x$ may be defined by $$\delta_X = \min_X \cos^{-L}(\cos\varphi\cos|\theta - X_\theta|),\ X \in \{L, R, C, Ls, Rs\}$$

where $L=[L_r, L_\theta, L_\phi]=[1, -30, 0]$, $R=[Rr, R\theta, R\phi]=[1, 30, 0]$, $C=[Cr, C\theta, C\phi]=[1, 0, 0]$, $Ls=[Lsr, Ls\theta, Ls\phi]=[1, -110, 0]$, and $Rs=[Rsr, Rs\theta, Rs\phi]=[1, 110, 0]$.

Processing at least one of the at least two object orientated audio signal channels based on the order of the at least two object orientated audio signal channels may cause the apparatus to: select a first set of the at least two object orientated audio signal channels, the first set of the at least two object orientated audio signal channels being the lower perceptually ordered channels; downmix the first set of the at least two object orientated audio signal channels to a downmixed channel representation; and output the downmixed channel representation with the remainder of the at least two object orientated audio signal channels.

Processing at least one of the at least two object orientated audio signal channels based on the order of the at least two object orientated audio signal channels may cause the apparatus to: select for parts of the at least two object orientated audio signal channels a highest perceptually ordered channel part; combine the selected highest perceptually ordered part to generate a first audio signal; attenuate the at least two object orientated audio signal channels highest perceptually ordered channel part; combine the attenuated at least two object orientated audio signal channels highest perceptually ordered channel part to the remainder at least two object orientated audio signal channel parts to generate a second audio signal; and output the first audio signal and the second audio signal.

The parts may be frequency sub-bands and/or bands of time periods of the at least two object orientated audio signal channels.

According to a second aspect there is provided a method comprising: perceptually ordering at least two object orientated audio signal channels; and processing at least one of the at least two object orientated audio signal channels based on the order of the at least two object orientated audio signal channels.

perceptually ordering at least two object orientated audio signal channels may comprise: determining a perception value for each of the at least two object orientated signal channels; and perceptually ordering the at least two object orientated audio signal channels based on the perception value.

Determining a perception value for each of the at least two object orientated signal channels may comprise determining a perception value based on the distance difference between the channel and a defined position.

The defined position may be a nearest of a set of speaker positions.

The set of speaker positions in polar co-ordinates may be $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

Determining a perception value for each of the at least two object orientated signal channels may comprise: dividing each of the at least two object orientated signal channels into time parts; determining for each time part of the at least two object orientated signal channel $C_x$ the following value:

$$perce(X) = \begin{cases} \frac{\|C_X\| - \|C_{MIN}\|}{\|C_{MAX}\| - \|C_{MIN}\|} \frac{\delta_X}{90^\circ}, & \|C_{MAX}\| \neq \|C_{MIN}\| \\ \frac{\delta_X}{90^\circ}, & \|C_{MAX}\| = \|C_{MIN}\| \end{cases}$$

where $\|C_x\|$ is the energy level of the channel $C_x$, $\|C_{max}\|$ the maximum energy level of the at least two channels at the time part, $\|C_{min}\|$ the minimum energy level of the at least two channels at the time part, and $\delta_x$ is the angular distance for the channel $C_x$ to a nearest of a set of speakers.

Determining a perception value for each of the at least two object orientated signal channels may comprise: dividing each of the at least two object orientated signal channels into time-frequency parts; determining for each time-frequency part of the at least two object orientated signal channel $C_x$ the following value:

$$perce(C_{X,b}) = \begin{cases} \frac{\|C_{X,b}\| - \|C_{MIN,b}\|}{\|C_{MAX,b}\| - \|C_{MIN,b}\|} \frac{\delta_X}{90^\circ}, & \|C_{MAX,b}\| \neq \|C_{MIN,b}\| \\ \frac{\delta_X}{90^\circ}, & \|C_{MAX,b}\| = \|C_{MIN,b}\| \end{cases}$$

where $\|C_{x,b}\|$ is the energy level of the channel for frequency band $C_x$, $\|C_{max,b}\|$ the maximum energy level of the at least two channels at the time frequency part, $\|C_{min,b}\|$ the minimum energy level of the at least two channels at the time frequency part, and $\delta_x$ is the angular distance for the channel $C_x$ to a nearest of a set of speakers.

Processing at least one of the at least two object orientated audio signal channels based on the order of the at least two object orientated audio signal channels may comprise: selecting a first set of the at least two object orientated audio signal channels, the first set of the at least two object orientated audio signal channels being the lower perceptually ordered channels; downmixing the first set of the at least two object orientated audio signal channels to a downmixed channel representation; and outputing the downmixed channel representation with the remainder of the at least two object orientated audio signal channels.

Processing at least one of the at least two object orientated audio signal channels based on the order of the at least two object orientated audio signal channels may comprise: selecting for parts of the at least two object orientated audio signal channels a highest perceptually ordered channel part; combining the selected highest perceptually ordered part to generate a first audio signal; attenuating the at least two object orientated audio signal channels highest perceptually ordered channel part; combining the attenuated at least two object orientated audio signal channels highest perceptually ordered channel part to the remainder at least two object orientated audio signal channel parts to generate a second audio signal; and outputting the first audio signal and the second audio signal.

The parts may be frequency sub-bands and/or bands of time periods of the at least two object orientated audio signal channels.

According to a third aspect there is provided an apparatus comprising: means for perceptually ordering at least two object orientated audio signal channels; and means for processing at least one of the at least two object orientated audio signal channels based on the order of the at least two object orientated audio signal channels.

The means for perceptually ordering at least two object orientated audio signal channels may comprise: means for determining a perception value for each of the at least two object orientated signal channels; and means for perceptually ordering the at least two object orientated audio signal channels based on the perception value.

The means for determining a perception value for each of the at least two object orientated signal channels may comprise means for determining a perception value based on the distance difference between the channel and a defined position.

The defined position may be a nearest of a set of speaker positions.

The set of speaker positions in polar co-ordinates may be $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

The means for determining a perception value for each of the at least two object orientated signal channels may comprise: means for dividing each of the at least two object orientated signal channels into time parts; means for determining for each time part of the at least two object orientated signal channel $C_x$ the following value:

$$perce(X)=\begin{cases}\dfrac{\|C_X\|-\|C_{MIN}\|}{\|C_{MAX}\|-\|C_{MIN}\|}\dfrac{\delta_X}{90^\circ}, & \|C_{MAX}\|\neq\|C_{MIN}\|\\ \dfrac{\delta_X}{90^\circ}, & \|C_{MAX}\|=\|C_{MIN}\|\end{cases}$$

where $\|C_x\|$ is the energy level of the channel $C_x$, $\|C_{max}\|$ the maximum energy level of the at least two channels at the time part, $\|C_{min}\|$ the minimum energy level of the at least two channels at the time part, and $\delta_x$ is the angular distance for the channel $C_x$ to a nearest of a set of speakers.

The means for determining a perception value for each of the at least two object orientated signal channels may comprise: means for dividing each of the at least two object orientated signal channels into time-frequency parts; means for determining for each time-frequency part of the at least two object orientated signal channel $C_x$ the following value:

$$perce(C_{X,b})=\begin{cases}\dfrac{\|C_{X,b}\|-\|C_{MIN,b}\|}{\|C_{MAX,b}\|-\|C_{MIN,b}\|}\dfrac{\delta_X}{90^\circ}, & \|C_{MAX,b}\|\neq\|C_{MIN,b}\|\\ \dfrac{\delta_X}{90^\circ}, & \|C_{MAX,b}\|=\|C_{MIN,b}\|\end{cases}$$

where $\|C_{x,b}\|$ is the energy level of the channel for frequency band Cx, $\|C_{max,b}\|$ the maximum energy level of the at least two channels at the time frequency part, $\|C_{min,b}\|$ the minimum energy level of the at least two channels at the time frequency part, and ox is the angular distance for the channel $C_x$ to a nearest of a set of speakers.

The value of $\delta_x$ may be defined by $$\delta_X=\min_X\cos^{-1}(\cos\varphi\cos|\theta-X_\theta|),\ X\in\{L, R, C, Ls, Rs\}$$

where L=[Lr, Lθ, Lϕ]=[1, −30, 0], R=[Rr, Rθ, Rϕ]=[1, 30, 0], C=[Cr, Cθ, Cϕ]=[1, 0, 0], Ls=[Lsr, LSθ, Lsϕ]=[1, −110, 0], and Rs=[Rsr, Rsθ, Rsϕ]=[1, 110, 0].

The means for processing at least one of the at least two object orientated audio signal channels based on the order of the at least two object orientated audio signal channels may comprise: means for selecting a first set of the at least two object orientated audio signal channels, the first set of the at least two object orientated audio signal channels being the lower perceptually ordered channels; means for downmixing the first set of the at least two object orientated audio signal channels to a downmixed channel representation; and means for outputting the downmixed channel representation with the remainder of the at least two object orientated audio signal channels.

The means for processing at least one of the at least two object orientated audio signal channels based on the order of the at least two object orientated audio signal channels may comprise: means for selecting for parts of the at least two object orientated audio signal channels a highest perceptually ordered channel part; means for combining the selected highest perceptually ordered part to generate a first audio signal; means for attenuating the at least two object orientated audio signal channels highest perceptually ordered channel part; means for combining the attenuated at least two object orientated audio signal channels highest perceptually ordered channel part to the remainder at least two object orientated audio signal channel parts to generate a second audio signal; and means for outputting the first audio signal and the second audio signal.

The parts may be frequency sub-bands and/or bands of time periods of the at least two object orientated audio signal channels.

According to a fourth aspect there is provided an apparatus comprising: a perception sorter configured to perceptually order at least two object orientated audio signal channels; and a selective channel processor configured to process at least one of the at least two object orientated audio signal channels based on the order of the at least two object orientated audio signal channels.

The perception sorter may comprise: a perception determiner configured to determine a perception value for each of the at least two object orientated signal channels; and perception metric sorter configured to perceptually order the at least two object orientated audio signal channels based on the perception value.

The perception determiner may be configured to determine a perception value based on the distance difference between the channel and a defined position.

The defined position may be a nearest of a set of speaker positions.

The set of speaker positions in polar co-ordinates may be $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

The perception determiner may be configured to: divide each of the at least two object orientated signal channels into time parts; determine for each time part of the at least two object orientated signal channel $C_x$ the following value:

$$perce(X)=\begin{cases}\dfrac{\|C_X\|-\|C_{MIN}\|}{\|C_{MAX}\|-\|C_{MIN}\|}\dfrac{\delta_X}{90^\circ}, & \|C_{MAX}\|\neq\|C_{MIN}\|\\ \dfrac{\delta_X}{90^\circ}, & \|C_{MAX}\|=\|C_{MIN}\|\end{cases}$$

where $\|C_x\|$ is the energy level of the channel $C_x$, $\|C_{max}\|$ the maximum energy level of the at least two channels at the time part, $\|C_{min}\|$ the minimum energy level of the at least two channels at the time part, and $\delta_x$ is the angular distance for the channel $C_x$ to a nearest of a set of speakers.

The perception determiner may be configured to: divide each of the at least two object orientated signal channels into time-frequency parts; determine for each time-frequency part of the at least two object orientated signal channel $C_x$ the following value:

$$perce(C_{X,b}) = \begin{cases} \frac{\|C_{X,b}\| - \|C_{MIN,b}\|}{\|C_{MAX,b}\| - \|C_{MIN,b}\|} \frac{\delta_X}{90^\circ}, & \|C_{MAX,b}\| \neq \|C_{MIN,b}\| \\ \frac{\delta_X}{90^\circ}, & \|C_{MAX,b}\| = \|C_{MIN,b}\| \end{cases}$$

where $\|C_{x,b}\|$ is the energy level of the channel for frequency band Cx, $\|C_{max,b}\|$ the maximum energy level of the at least two channels at the time frequency part, $\|C_{min,b}\|$ the minimum energy level of the at least two channels at the time frequency part, and $\delta_x$ is the angular distance for the channel $C_x$ to a nearest of a set of speakers.

The value of $\delta_x$ may be defined by $$\delta_X = \min_X \cos^{-1}(\cos\varphi\cos|\theta - X_\theta|),\ X \in \{L, R, C, Ls, Rs\}$$

where L=[Lr, Lθ, Lϕ]=[1, −30, 0], R=[Rr, Rθ, Rϕ]=[1, 30, 0], C=[Cr, Cθ, Cϕ]=[1, 0, 0], Ls=[Lsr, Lsθ, Lsϕ]=[1, −110, 0], and Rs=[Rsr, Rsθ, Rsϕ]=[1, 110, 0].

The selective channel processor may comprise: a perception filter configured select a first set of the at least two object orientated audio signal channels, the first set of the at least two object orientated audio signal channels being the lower perceptually ordered channels; a downmixer configured to downmix the first set of the at least two object orientated audio signal channels to a downmixed channel representation; and an output configured to output the downmixed channel representation with the remainder of the at least two object orientated audio signal channels.

The selective channel processor may comprise: a perception filter configured to select for parts of the at least two object orientated audio signal channels a highest perceptually ordered channel part; a mid channel generator configured to combine the selected highest perceptually ordered part to generate a first audio signal; an attenuator configured to attenuate the at least two object orientated audio signal channels highest perceptually ordered channel part; a side channel generator configured to combine the attenuated at least two object orientated audio signal channels highest perceptually ordered channel part to the remainder at least two object orientated audio signal channel parts to generate a second audio signal; and an output configured to output the first audio signal and the second audio signal.

The parts may be frequency sub-bands and/or bands of time periods of the at least two object orientated audio signal channels.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS

The following describes in further detail suitable apparatus and possible mechanisms for the provision of effective spatial object oriented audio signal format processing.

The concept as embodied in the examples described herein is utilizing object oriented audio signal formats, for example the Dolby Atmos audio format, in a mobile device. As described herein the computational limits and other resource capacity issues make it difficult if not practically impossible to apply object oriented audio signal formats such as the Atmos format in mobile devices with limited bandwidth, storage and processing capacities.

In such a manner a scalable version of object oriented audio signal formats can be generated. In such embodiments as described herein both the compactness of regular surround audio and most of the benefits from an object oriented audio format can be retained.

Figure 1:
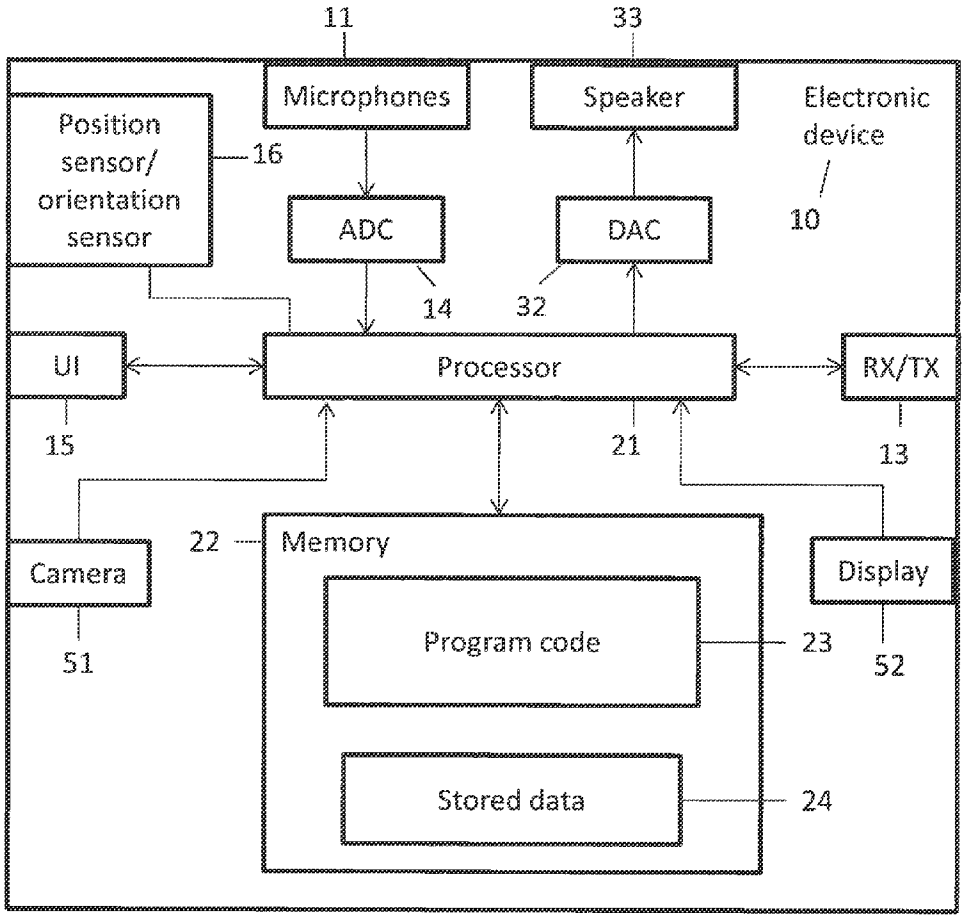
FIG. 1 shows schematically an apparatus suitable for being employed in some embodiments.

In this regard reference is first made to FIG. 1 which shows a schematic block diagram of an exemplary apparatus or electronic device 10, which may be used to convert the audio signals from an object oriented format to a hybrid or other format suitable to output to a playback device or apparatus.

The electronic device 10 may for example be a mobile terminal or user equipment of a wireless communication system when functioning as an audio capturer or format converting apparatus. In some embodiments the apparatus can be an audio server for supplying audio signals to a suitable player or audio recorder, such as an MP3 player, a media recorder/player (also known as an MP4 player), or any suitable portable apparatus suitable for recording audio or audio/video camcorder/memory audio or video recorder.

The apparatus 10 can in some embodiments comprise an audio-video subsystem. The audio-video subsystem for example can comprise in some embodiments a microphone or array of microphones 11 for audio signal capture. In some embodiments the microphone or array of microphones can be a solid state microphone, in other words capable of capturing audio signals and outputting a suitable digital format signal. In some other embodiments the microphone or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or micro electrical-mechanical system (MEMS) microphone. In some embodiments the microphone 11 is a digital microphone array, in other words configured to generate a digital signal output (and thus not requiring an analogue-to-digital converter). The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments the microphones are 'integrated' microphones containing both audio signal generating and analogue-to-digital conversion capability.

In some embodiments the apparatus 10 audio-video subsystem further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio-video subsystem can comprise in some embodiments a speaker 33. The speaker 33 can in some embodiments receive the output from the digital-to-analogue converter 32 and present the analogue audio signal to the user. In some embodiments the speaker 33 can be representative of multi-speaker arrangement, a headset, for example a set of headphones, or cordless headphones.

In some embodiments the apparatus audio-video subsystem comprises a camera 51 or image capturing means configured to supply to the processor 21 image data. In some embodiments the camera can be configured to supply multiple images over time to provide a video stream.

In some embodiments the apparatus audio-video subsystem comprises a display 52. The display or image display means can be configured to output visual images which can be viewed by the user of the apparatus. In some embodiments the display can be a touch screen display suitable for supplying input data to the apparatus. The display can be any suitable display technology, for example the display can be implemented by a flat panel comprising cells of LCD, LED, OLED, or 'plasma' display implementations.

Although the apparatus 10 is shown having both audio/video capture and audio/video presentation components, it would be understood that in some embodiments the apparatus 10 can comprise only the audio capture parts of the audio subsystem such that in some embodiments of the apparatus the microphone (for audio capture) is present.

In some embodiments the apparatus 10 comprises a processor 21. The processor 21 is coupled to the audio-video subsystem and specifically in some examples the analogue-to-digital converter 14 for receiving digital signals representing audio signals from the microphone 11, the digital-to-analogue converter (DAC) 12 configured to output processed digital audio signals, the camera 51 for receiving digital signals representing video signals, and the display 52 configured to output processed digital video signals from the processor 21.

The processor 21 can be configured to execute various program codes. The implemented program codes can comprise for example audio-video recording and audio-video presentation routines. For example in some embodiments the processor is suitable for generating object oriented audio format signals and storing such a format. In some embodiments the program codes can be configured to perform audio format conversion as described herein.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been converted in accordance with the application or data to be encoded via the application embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments as described herein comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling. For example in some embodiments the transceiver 13 can be configured to output the audio signals in a hybrid object orientated audio format or other format converted from the object orientated audio format.

The transceiver 13 can communicate with further apparatus by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, and a gyroscope or be determined by the motion of the apparatus using the positioning estimate.

It is to be understood again that the structure of the electronic device 10 could be supplemented and varied in many ways.

Figure 2:
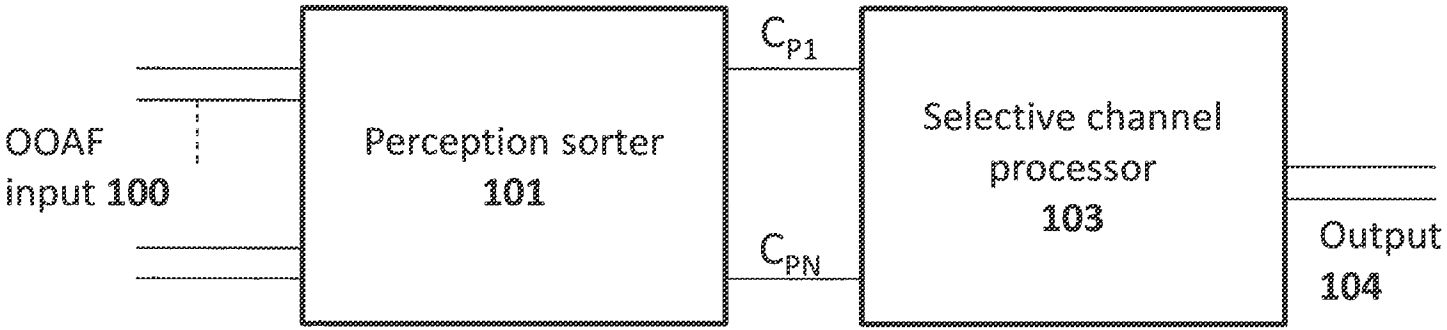
FIG. 2 shows schematically an example spatial object oriented audio signal format processing apparatus according to some embodiments.

With respect to FIG. 2 an example object oriented audio format processor is shown. Furthermore with respect to FIG. 3 the operation of the example object oriented audio format processor is shown.

In some embodiments the object oriented audio format processor comprises a perception sorter 101. The perception sorter 101 is configured to receive the object oriented audio format signals channels. There can be a significant number of channels, for example Dolby Atmos can use up to 200 individual channels.

Figure 3:
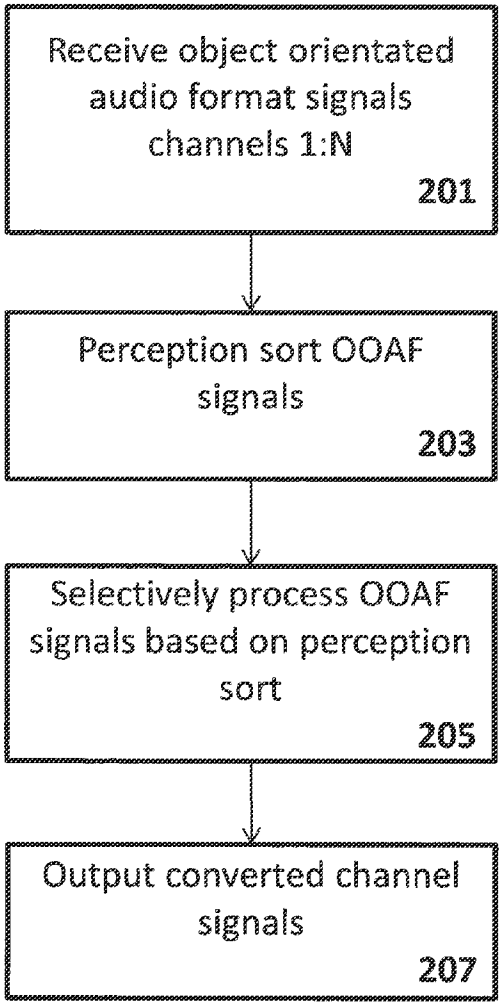
FIG. 3 shows schematically a flow diagram of the spatial object oriented audio signal format processing apparatus shown in FIG. 2 according to some embodiments.

The operation of receiving the object oriented audio format signals is shown in FIG. 3 by step 201.

The perception sorter 101 can then be configured to perceptually rate each of these channels and sort the channels according to the perception rating value.

The perception sorter 101 can then output the perception sorted channels $C_{p1}$ to $C_{pN}$ to a selective channel processor 103.

In some embodiments the object oriented audio format converter comprises a selective channel processor 103. The selective channel processor 103 can be configured to receive the perception sorted channel information and selectively process channels based on the perception sorted values.

The operation of selectively processing the object oriented audio format signals based on perception sort is shown in FIG. 3 by step 205.

The selective channel processor 103 can then output the converted channel signals according to the channel processing performed.

The operation of outputting the converted channel signals is shown in FIG. 3 by step 207.

Figure 4:
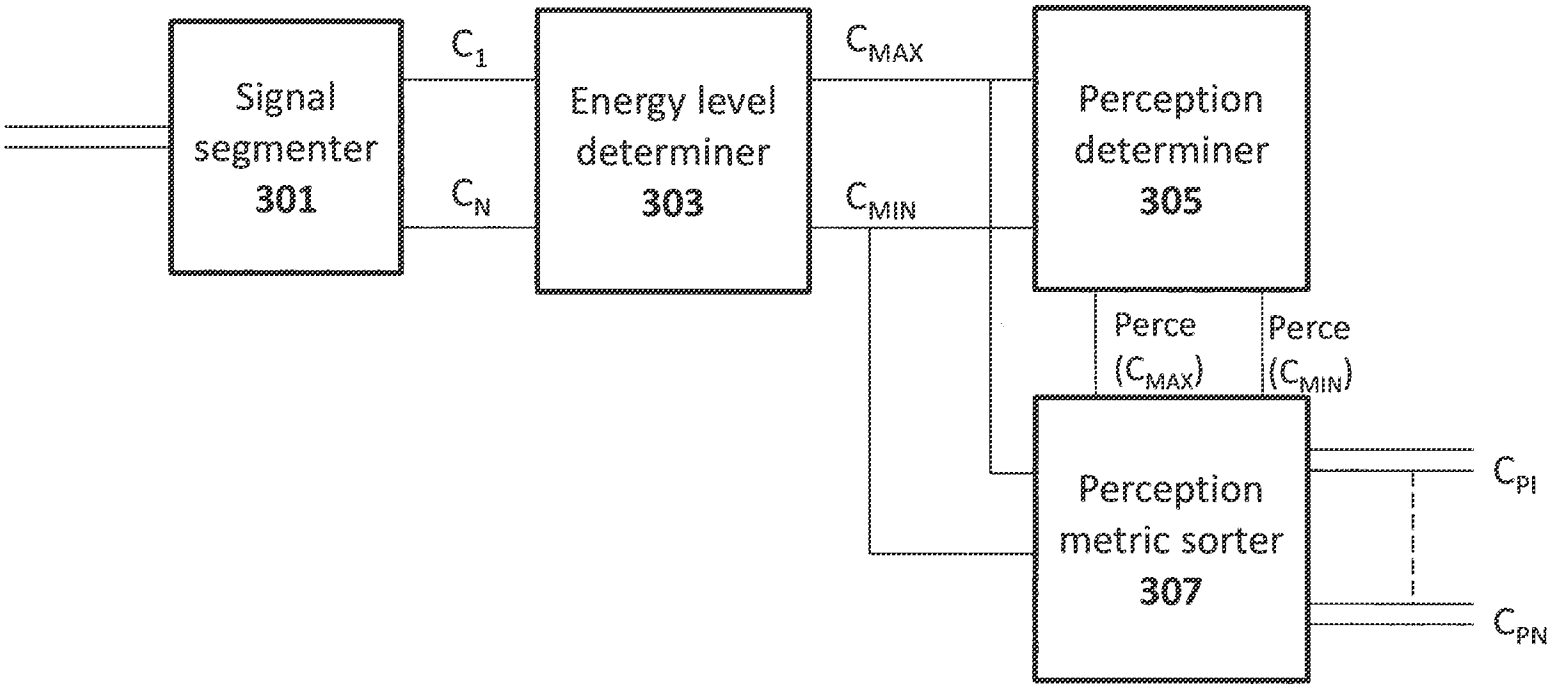
FIG. 4 shows schematically an example of the perceptual importance sorter as shown in FIG. 2 according to some embodiments

With respect to FIG. 4 an example perception sorter 101 is shown in further detail. Furthermore with respect to FIG. 5 the operation of the example perception sorter as shown in FIG. 4 is shown in further detail.

In some embodiments the perception sorter 101 comprises a signal segmenter 301. The signal segmenter 301 can in some embodiments be configured to receive the object oriented audio format signals.

Figure 5:
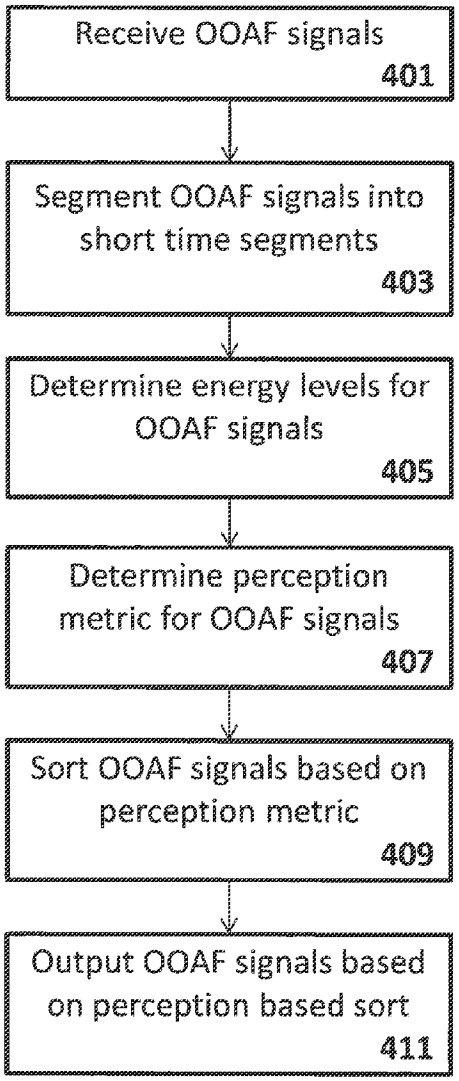
FIG. 5 shows schematically a flow diagram of the operation of the perceptual importance sorter as shown in FIG. 4 according to some embodiments.

The operation of receiving the object oriented audio format signals is shown in FIG. 5 by step 401.

In some embodiments the signal segmenter 301 is configured to segment the audio signals into short time segments. For example in some embodiments the short time segments are 20 ms segments. In some embodiments the short time segments are overlapping short time segments. In other words that each of the segments comprise an element of the preceding segment and an element of the succeeding segment. For example in some embodiments the short time segments are 20 ms segments which overlap 10 ms with the preceding short time segment and 10 ms with the succeeding short time segment.

In some embodiments the signal segmenter 301 is configured to output the time domain signal segmented short time segments to an energy level determiner 303. In the example shown in FIG. 4 these are shown as channels $C_1$ to $C_N$.

The operation of segmenting the object oriented audio format signals into short time segments is shown in FIG. 5 by step 403.

In some embodiments the signal segmenter 301 is further configured to segment the object oriented audio format signals in the frequency domain as well as in the time domain. In such embodiments the short time segments can be converted by a suitable Time-to-Frequency domain converter. The Time-to-Frequency Domain Transformer or suitable transformer means can be configured to perform any suitable time-to-frequency domain transformation on the segmented or frame audio data. In some embodiments the Time-to-Frequency Domain Transformer can be a Discrete Fourier Transformer (DFT). However the Transformer can be any suitable Transformer such as a Discrete Cosine Transformer (DCT), a Modified Discrete Cosine Transformer (MDCT), a Fast Fourier Transformer (FFT) or a quadrature mirror filter (QMF). The Time-to-Frequency Domain Transformer can be configured to output a frequency domain signal for each channel to a sub-band filter.

In some embodiments the signal segmenter comprises a sub-band filter configured to sub-band or band filter the frequency domain short time segment or frame representations. In other words for each of the channels $C_1$ to $C_N$ are generated channel representations $C_{1,1}$ to $C_{1,B}$ and $C_{N,1}$ to $C_{N,B}$, where N is the number of input channels and B the number of sub bands for each channel. The sub-band filter or suitable means can be configured to receive the frequency domain signals from the Time-to-Frequency Domain Transformer and divide each frequency domain representation signal into a number of sub-bands.

The sub-band division can be any suitable sub-band division. For example in some embodiments the sub-band filter can be configured to operate using psychoacoustic filtering bands. The sub-band filter can then be configured to output each domain range sub-band to the energy level determiner 303.

In some embodiments the perception sorter 101 comprises an energy level determiner 303. The energy level determiner 303 can be configured to receive the representations (either in the time domain $C_a$ or frequency domain $C_{a,b}$) and can determine energy levels for the object oriented audio format channel signals $\|C_a\|$ or $\|C_{a,b}\|$. The energy level determiner 303 can then be configured to further determine the 'loudest' channel value $\|C_{max}\|$ and the quietest channel value $\|C_{min}\|$ from the energy of the signal for each signal segment.

The energy level determiner 303 can then be configured to output the channels to the perception determiner 305 and further to the perception sorter 307.

The operation of determining the energy levels for the object oriented audio format signals is shown in FIG. 5 by step 405.

In some embodiments the perception sorter 101 comprises a perception determiner 305. The perception determiner 305 is configured to receive the channels $C_a$ (or frequency domain $C_{a,b}$) and energy levels for the object oriented audio format channel signals $\|C_a\|$ (or $\|C_{a,b}\|$) and from these determine a perceptual importance value which can be used to sort the object oriented audio format signals in a suitable format. Perceptually the most important channels are the loudest ones and those that are meant to be played from a position away from the speakers in a defined (such as a 5.1 format) downmix. These positions include for example above or below the listener or straight behind as these channels aren't properly expressed by the 5.1 downmix which has no height (=azimuth) information nor a speaker straight behind.

In some embodiments the perception determiner 305 is configured to generate a perception value for a channel $C_x$ short time segment according to the following equation:

$$perce(X) = \begin{cases} \frac{\|C_X\| - \|C_{MIN}\|}{\|C_{MAX}\| - \|C_{MIN}\|} \frac{\delta_X}{90^\circ}, & \|C_{MAX}\| \neq \|C_{MIN}\| \\ \frac{\delta_X}{90^\circ}, & \|C_{MAX}\| = \|C_{MIN}\| \end{cases}$$

where $\delta_x$ is the trajectory direction for channel $C_x$ and can be defined as being the angular distance δ for the channel from point P=[r, θ, φ] to the nearest speaker as follows:

$$\delta_X = \min_X \cos^{-1}(\cos\varphi\cos|\theta - X_\theta|),\ X \in \{L, R, C, Ls, Rs\}$$

where for a 5.1 multichannel system $L=[L_r, L_\theta, L_\phi]=[1, -30, 0]$ $R=[R_r, R_\theta, R_\phi]=[1, 30, 0]$ $C=[C_r, C_\theta, C_\phi]=[1, 0, 0]$ $Ls=[Ls_r, Ls_\theta, Ls_\theta]=[1, -110, 0]$ $Rs=[Rs_r, Rs_\theta, Rs_\phi]=[1, 110, 0]$, and where the numbers are radius, polar angle and azimuth. We can assume the radius to be 1 without loss of generality.

The angular distance can be at minimum 0 and at maximum 90 degrees.

The perception determiner 305 can then be configured to output the perception values perce($C_x$) to the perception sorter 307.

The determination of the perception metric for each of the channels is shown in FIG. 5 by step 407.

In some embodiments it would be understood that the perception determiner is configured to determine a perception value associated with each of the channel sub-bands. In such embodiments the perception determiner 305 is configured to generate a perception value for a channel Cx,b short time segment for channel x and sub-band b according to the following equation:

$$perce(C_{X,b}) = \begin{cases} \frac{\|C_{X,b}\| - \|C_{MIN,b}\|}{\|C_{MAX,b}\| - \|C_{MIN,b}\|} \frac{\delta_X}{90^\circ}, & \|C_{MAX,b}\| \neq \|C_{MIN,b}\| \\ \frac{\delta_X}{90^\circ}, & \|C_{MAX,b}\| = \|C_{MIN,b}\| \end{cases}$$

where $\|C_{MAX,b}\|$ and $\|C_{MIN,b}\|$ are the energies of bands b in the channels that have the largest and smallest energy in band b respectively.

In some embodiments the perception sorter 101 comprises a perception metric sorter 307 configured to receive the channels and the perception values associated with each of these channels. The perception metric sorter 307 can then be configured to sort the channels according to the perception metric value. Thus in some embodiments the perception metric sorter 307 can be configured to output the channels and associated trajectory information to the selective channel processor 103 in a form where the selective channel processor 103 is able to determine the order of perceptually important channels.

The operation of sorting the object oriented audio format signals based on the perception metric is shown in FIG. 5 by step 409.

The operation of outputting the object oriented audio formats signals based on perception based sort is shown in FIG. 5 by step 411.

Figure 6:
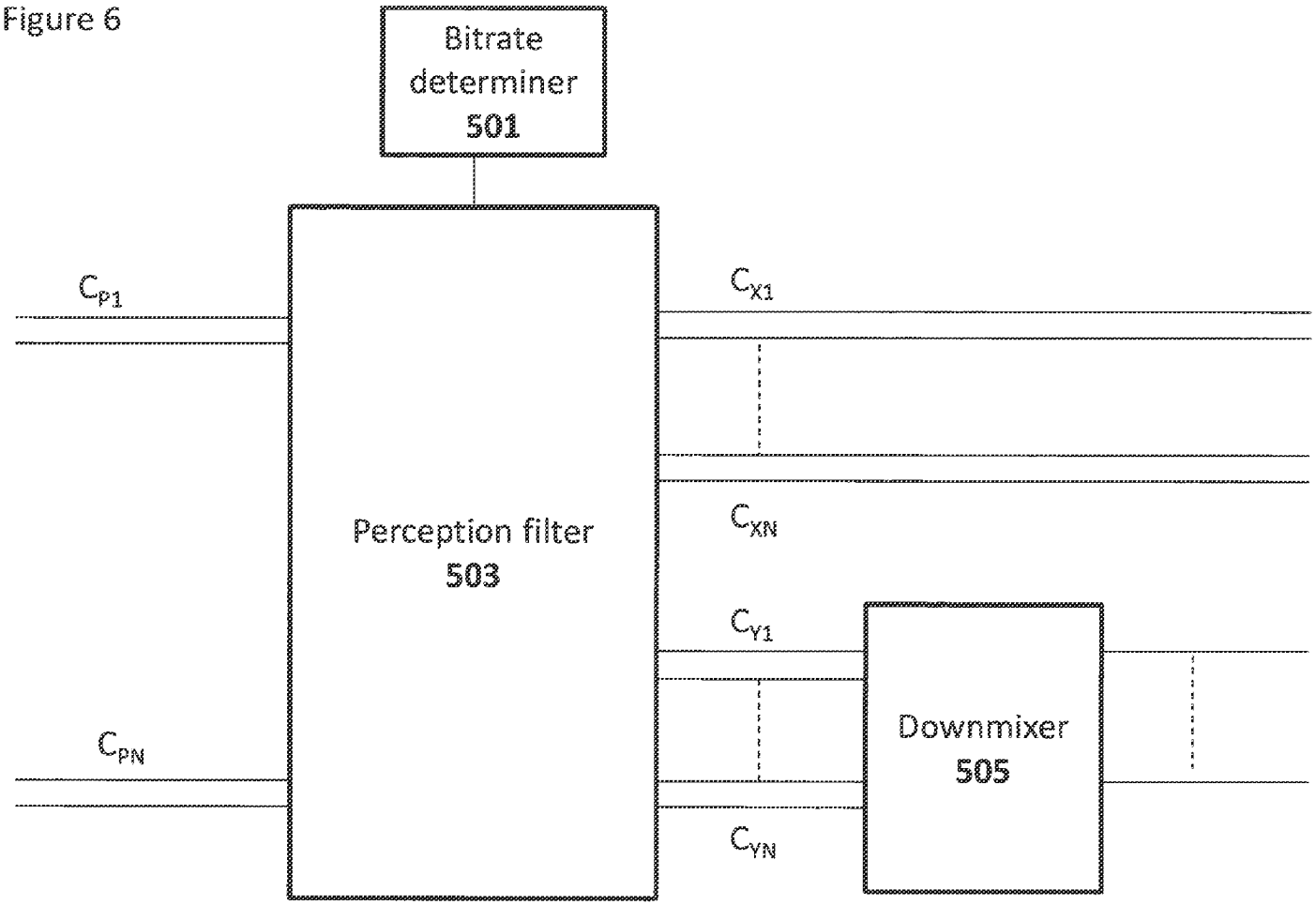
FIG. 6 shows schematically an example of the selective channel processor as shown in FIG. 2 according to some embodiments.

With respect to FIG. 6 an example selective channel processor 103 is shown in further detail. Furthermore with respect to FIG. 7 the operation of the example selective channel processor 103 is shown in further detail. In some embodiments the selective channel processor 103 comprises a bit rate or resource determiner 501. The bit rate or resource determiner 501 can be configured to allocate or determine available resource capacity for the perception filter (or selective channel processor in general) can operate at. In some embodiments the bit rate or resource determiner 501 can be configured to determine the available resource capacity based on communication with a remote device configured to playback the audio signal. However, in some embodiments the bit rate or resource determiner 501 can be configured to use pre-defined or defined template values.

Figure 7:
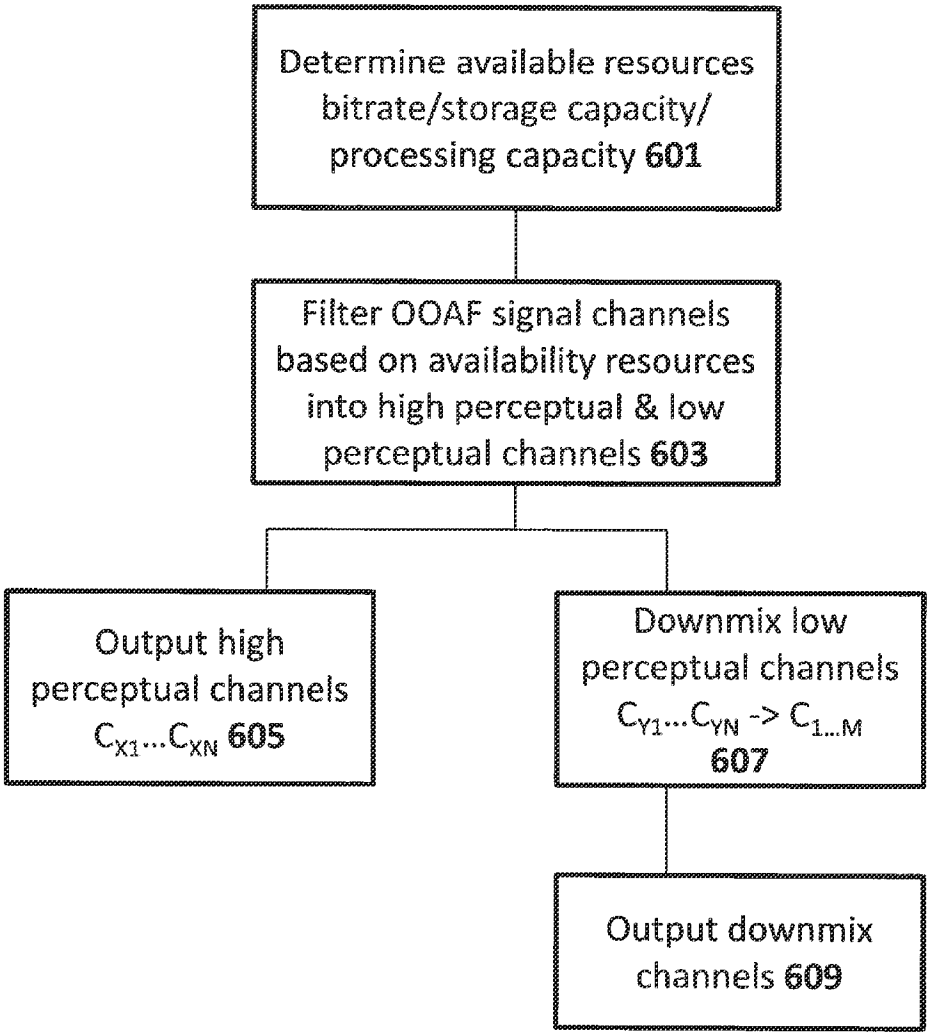
FIG. 7 shows schematically a flow diagram of the operation of the selective channel processor as shown in FIG. 6 according to some embodiments.

The determination of available resources such as bit rate/storage/processing capacity is shown in FIG. 7 by step 601.

In some embodiments the selective channel processor 103 comprises a perception filter 503. The perception filter 503 is configured to receive the perception sorted object-oriented audio signal channels $C_{P1}$ to $C_{PN}$ and filter the object-oriented audio format signals channels based on the determined available resources. In some embodiments the perception filter 503 is configured to filter the channels into high perception channels and low perception channels. The selection of the number of channels to be filtered is based on the available resources.

The perception filter 503 therefore can output the low perceptual channels $C_{Y1}$ to $C_{YK}$ to a downmixer 505 while passing the high perceptual channels $C_{x1}$ to $C_{xH}$ to be output.

The operation of filtering the object-oriented audio format signal channels based on the available resources based on the perception values into high perception and low perceptual channels is shown in FIG. 7 by step 603.

Furthermore the outputting of the high perception channels directly is shown in FIG. 7 by step 605.

In some embodiments the selective channel processor 103 comprises a downmixer 505. The downmixer 505 is configured to receive the low perceptual channels $C_{Y1}$ to $C_{YK}$ and downmix these channels with their associated trajectories into a defined number of output channels. For example the downmixer 505 can be configured to output a 5.1 channel configuration with a left (L), right (R), centre (C), left surround (Ls), and right surround (Rs) speakers and associated sub-woofer or ambience signal. However it would be understood that the downmixer 505 can be configured to output any suitable stereo or multichannel output signal.

The operation of down mixing the low perception channels to a small number of channels such as five channels or two channels is shown in FIG. 7 by step 607.

The downmixer 505 can then output the downmixed channels. The operation of outputting the downmixed channels is shown in FIG. 7 by step 609.

In such a manner the number of channels is significantly reduced such that the apparatus configured to receive the channels can process the hybrid audio format and playback the audio format in such a way that the playback device can render the channels using limited resources.

Figure 8:
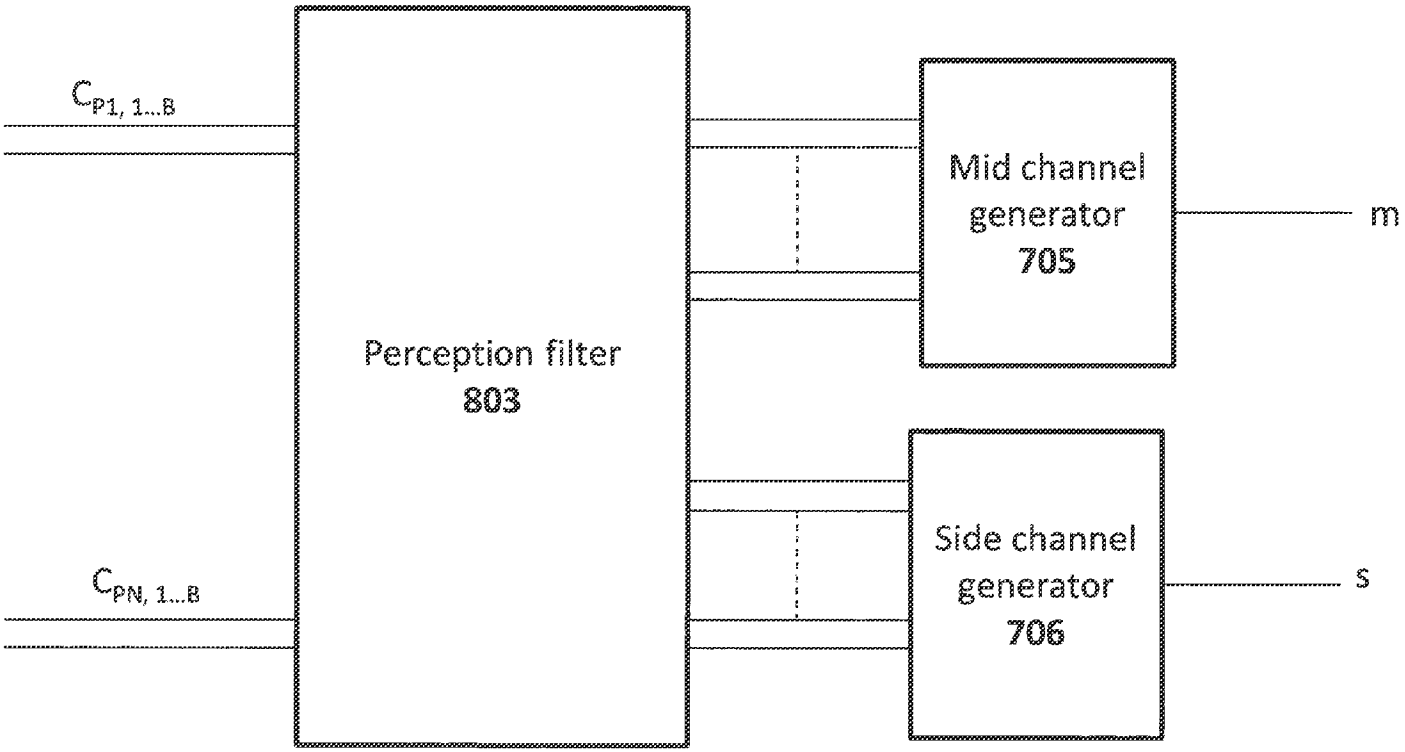
FIG. 8 shows schematically a further example of the selective channel processor as shown in FIG. 2 according to some embodiments.

With respect to FIG. 8 a further example of a selective channel processor 103 is shown. Furthermore with respect to FIG. 9 a flow diagram showing the operation of the further example of a selective channel processor is shown.

The selective channel processor 103 in some embodiments comprises a perception filter 703. The perception filter 703 is configured to receive each of the channels in the form of sorted sub-band object oriented audio format signal channels.

Figure 9:
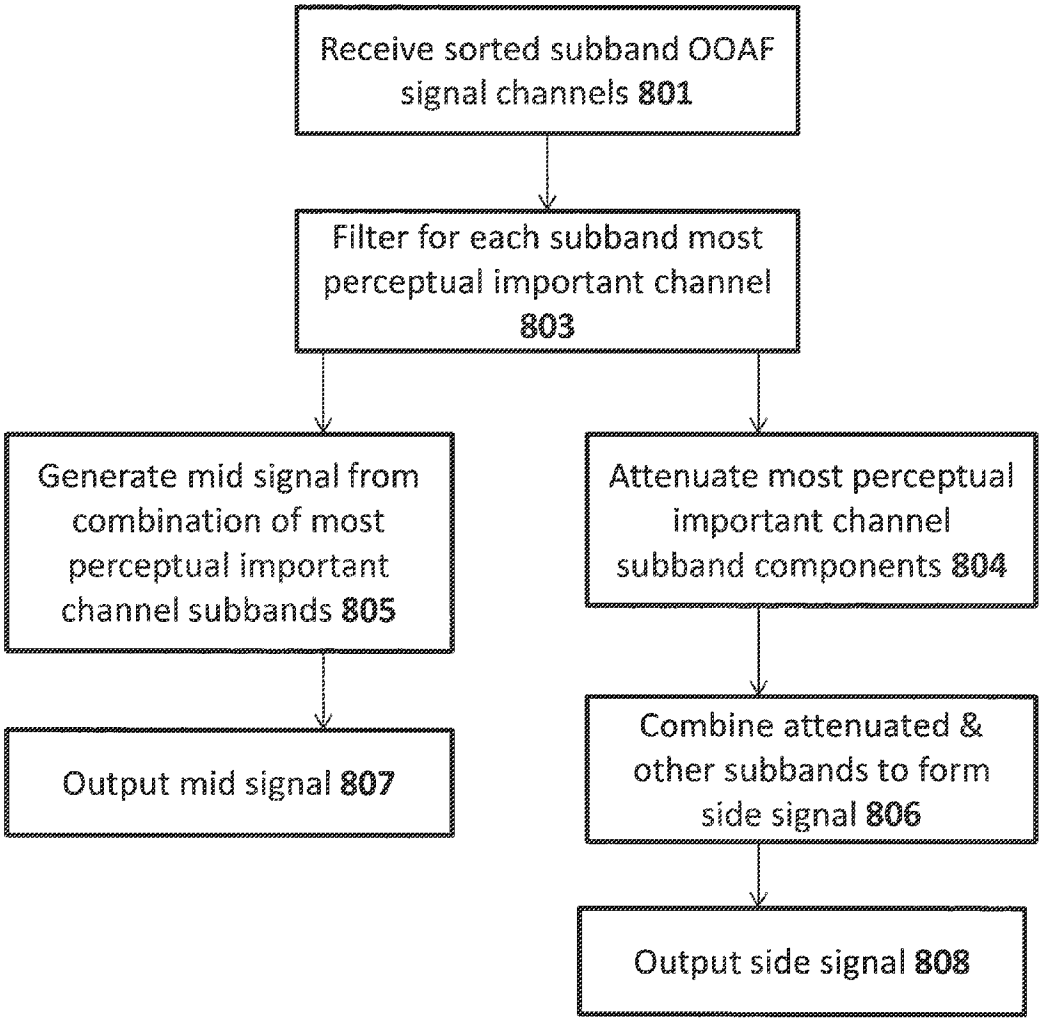
FIG. 9 shows schematically a flow diagram of the operation of the further example selective channel processor as shown in FIG. 8 according to some embodiments.

The operation of receiving sorted sub-band object-oriented audio format signal channels is shown in FIG. 9 by step 801.

The perception filter can then be configured to filter or select from all of the channel sub-bands the channel sub-band which has the highest perceptual importance, in other words with the highest perceptual metric value and pass this value to a mid channel generator 705. Thus for example where channel $C_{P1}$ had the most important 1st band, $C_{P2}$ had the most important 2nd band, the Mid channel generator receives the components $C_{P1,1}$, $C_{P2,2}$, . . . , $C_{PB,B}$.

The operation of filtering for the channel sub-bands the most perceptual important channel sub-band is shown in FIG. 9 by step 803.

Furthermore for the same channel elements the perception filter can be configured to attenuate the most perceptual important channel sideband components by a factor α. The factor α has a value $0 \leq \alpha \leq 1$. The value of α can in some embodiments be determined manually and is a compromise between possible artefacts and directionality effect.

The attenuated perceptual important channel sideband components and the other components, the non-important channel components are passed to a side channel generator 706. In other words using the above example the output to the side channel generator is $C_{P1}'$ where $C_{P1}'=[\alpha C_{P1,1}, C_{P1,2}, \ldots, C_{P1,B}]$, and channel $C_{P2}'$ where $C_{PN}'=[C_{P2,1}, \alpha C_{P2,2}, \ldots, C_{P2,B}]$.

The operation of attenuating the most perceptual important channel components is shown in FIG. 9 by step 804.

In some embodiments the selective channel processor 103 comprises a mid channel generator 705. The mid channel generator 705 is configured to receive from the perception filter the most perceptual important channel sub-band components. The mid channel generate 705 can then be configured to combine these to generate a mid signal. Thus according to the example shown above the mid signal is generated from the sub-band components according to $M=[C_{P1,1}, C_{P2,2}, \ldots, C_{PB,B}]$.

The operation of generating the mid signal from the combined combination of the most perceptual important channel sub bands is shown in FIG. 9 by step 805.

The mid channel generator 705 can then be configured to output the mid signal M.

The operation of outputting the mid signal is shown in FIG. 9 by step 807.

In some embodiments the selective channel processor 103 comprises a side channel generator 706. The side channel generator 706 is configured to combine the attenuated most perceptual important channel sideband components with the other sideband components to form the side signal. Using the above example the side signal is generated from $$S=C_{p1}'+C_{p2}'+\ldots+C_{pN}'$$

The operation of combining the attenuated perceptual important and other side bands to form the side signal is shown in FIG. 9 by step 806.

Furthermore the side channel generator 706 can then be configured to output the side signal S.

The operation of outputting the side signal is shown in FIG. 9 by step 808.

It would be understood that in some embodiments the mid signal generator is further configured to output the object trajectory information associated with each of the perceptual important sub-bands.

The output mid and side signals can be rendered and output on a suitable playback device. For example in some embodiments a playback device can comprise a decoder which receives the mid signal and the side signal, and the associated direction information (the trajectory information).

In such playback apparatus the mid, side and directional information is rendered according to the suitable output format. For example in a stereo output the following operations can be performed to generate a left and right channel signal for the audio output. For example in some embodiments a HRTF can be applied to the low frequency components of the mid signal for sub-band b at segment n $M^b(n)$ and the directional component $$\tilde{M}(n)=M^b(n)H_{L,\alpha_b}(n_b+n), n=0, \ldots, n_{b+1}-n_b-1,$$

$$\tilde{M}_R{}^b(n)=M^b(n)H_{R,\alpha_b}(n_b+n), n=0, \ldots, n_{b+1}-n_b-1.$$

The usage of HRTFs is straightforward. For direction (angle) β, there are HRTF filters for left and right ears, $HL_\beta(z)$ and $HR_\beta(z)$, respectively. A binaural signal with sound source S(z) in direction β is generated straightforwardly as $L(z)=HL_\beta(z)S(z)$ and $R(z)=HR_\beta(z)S(z)$, where L(z) and R(z) are the input signals for left and right ears.

The same filtering can be performed in DFT domain as presented for the subbands at higher frequencies the processing goes as follows:

$$\tilde{M}_L^b(n) = M^b(n)|H_{L,\alpha_b}(n_b+n)|e^{-j\frac{2\pi(n+n_b)\tau_{HRTF}}{N}}, n = 0, \ldots, n_{b+1}-n_b-1,$$

$$\tilde{M}_R^b(n) = M^b(n)|H_{R,\alpha_b}(n_b+n)|e^{-j\frac{2\pi(n+n_b)\tau_{HRTF}}{N}}, n = 0, \ldots, n_{b+1}-n_b+1$$

In these embodiments it can be seen that only the magnitude part of the HRTF filters are used, in other words the delays are not modified. On the other hand, a fixed delay of $\tau_{HRTF}$ samples is added to the signal. This is used because the processing of the low frequencies introduces a delay to the signal. In some embodiments to avoid a mismatch between low and high frequencies, this delay needs to be compensated. $\tau_{HRTF}$ is the average delay introduced by HRTF filtering and it has been found that delaying all the high frequencies with this average delay provides good results. The value of the average delay is dependent on the distance between sound sources and microphones in the used HRTF set.

The side signal does not have any directional information, and thus no HRTF processing is needed. However in some embodiments delay caused by the HRTF filtering has to be compensated also for the side signal. This is done similarly as for the high frequencies of the mid signal:

$$\tilde{S}^b(n) = S^b(n)e^{-j\frac{2\pi(n+n_b)\tau_{HRTF}}{N}}, n = 0, \ldots, n_{b+1}-n_b-1$$

For the side signal, the processing is equal for low and high frequencies.

The mid and side signals are then in some embodiments combined to determine left and right output channel signals. As HRTF filtering typically amplifies or attenuates certain frequency regions in the signal therefore in some embodiments the amplitudes of the mid and side signals may not correspond to each other. In some embodiments the average energy of mid signal is returned to the original level, while still maintaining the level difference between left and right channels. In one approach, this is performed separately for every subband.

The scaling factor for subband b is obtained as $$\varepsilon^b = \sqrt{\frac{2\left(\sum_{n=n_b}^{n_{b+1}-1} |M^b(n)|^2\right)}{\sum_{n=n_b}^{n_{b+1}-1} |\tilde{M}_L^b(n)|^2 + \sum_{n=n_b}^{n_{b+1}-1} |\tilde{M}_R^b(n)|^2}}.$$

Now the scaled mid signal is obtained as:

$$\overline{M}_L{}^b = \epsilon^b \tilde{M}_L{}^b,$$

$$\overline{M}_R{}^b = \epsilon^b \tilde{M}_R{}^b.$$

Synthesized mid and side signals signals $\overline{M}_L$, $\overline{M}_R$ and $\overline{S}$ are transformed to the time domain in some embodiments using an inverse DFT (IDFT) or other suitable frequency to domain transform. In some embodiments an exemplary embodiment, $D_{tot}$ last samples of the frames are removed and sinusoidal windowing is applied. The new frame is in some embodiments combined with the previous one with, in an exemplary embodiment, 50 percent overlap, resulting in the overlapping part of the synthesized signals $m_L(t)$, $m_R(t)$ and s(t).

In some embodiments the externalization of the output signal can be further enhanced by the means of decorrelation. In an embodiment, decorrelation is applied only to the side signal, which represents the ambience part. Many kinds of decorrelation methods can be used, but described here is a method applying an all-pass type of decorrelation filter to the synthesized binaural signals. The applied filter is of the form $$D_L(z) = \frac{\beta + z^{-P}}{1 + \beta z^{-P}}, \quad (20)$$

$$D_R(z) = \frac{-\beta + z^{-P}}{1 - \beta z^{-P}}.$$

where P is set to a fixed value, for example 50 samples for a 32 kHz signal. The parameter β is used such that the parameter is assigned opposite values for the two channels. For example 0.4 is a suitable value for β. It would be understood that there is a different decorrelation filter for each of the left and right channels.

The output left and right channels are now obtained in some embodiments as:

$$L(z) = z^{-P_D} M_L(z) + D_L(z) S(z)$$

$$R(z) = z^{-P_D} M_R(z) + D_R(z) S(z)$$

It shall be appreciated that the term user equipment is intended to cover any suitable type of wireless user equipment, such as mobile telephones, portable data processing devices or portable web browsers, as well as wearable devices.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer code for one or more programs, the at least one memory and the computer code configured to with the at least one processor cause the apparatus to at least:

determine a perception value for each of at least two object orientated signal channels, wherein for each of the at least two object orientated signal channels the apparatus is caused to determine a perception value of an object orientated signal channel of the at least two object orientated signal channels based at least in part on an angular distance for the object orientated signal channel to a defined position, perceptually order the at least two object orientated audio signal channels based on the perception value for each of the at least two object orientated audio signal channels; and process at least one of the at least two object orientated audio signal channels based at least in part on the order of the at least two object orientated audio signal channels.

2. The apparatus as claimed in claim 1, wherein the defined position is a nearest speaker position of a set of speaker positions.

3. The apparatus as claimed in claim 2, wherein the set of speaker positions in polar co-ordinates are $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

4. The apparatus as claimed in claim 1, wherein the apparatus caused to process the at least one of the at least two object orientated audio signal channels based on the order of the at least two object orientated audio signal channels is further caused to:

select a first set of the at least two object orientated audio signal channels, the first set of the at least two object orientated audio signal channels being the lowest of the perceptually ordered channels;

downmix the first set of the at least two object orientated audio signal channels to a downmixed channel representation; and output the downmixed channel representation with the remainder of the at least two object orientated audio signal channels.

5. The apparatus as claimed in claim 1, wherein the apparatus caused to process the at least one of the at least two object orientated audio signal channels based on the order of the at least two object orientated audio signal channels is further caused to:

select for parts of the at least two object orientated audio signal channels a highest perceptually ordered channel part;

combine the selected highest perceptually ordered part to generate a first audio signal;

attenuate the at least two object orientated audio signal channels highest perceptually ordered channel part;

combine the attenuated at least two object orientated audio signal channels highest perceptually ordered channel part to the remainder at least two object orientated audio signal channel parts to generate a second audio signal; and output the first audio signal and the second audio signal.

6. The apparatus as claimed in claim 5, wherein the parts are frequency sub-bands and/or bands of time periods of the at least two object orientated audio signal channels.

7. A method comprising:

determining a perception value for each of at least two object orientated signal channels by determining, for each of the at least two object orientated signal channels, a perception value of an object orientated signal channel of the at least two object orientated signal channels based at least in part on an angular distance for the object orientated signal channel to a defined position;

perceptually ordering the at least two object orientated audio signal channels based on the perception value for each of the at least two object orientated audio signal channels; and processing at least one of the at least two object orientated audio signal channels based at least in part on the order of the at least two object orientated audio signal channels.

8. The method as claimed in claim 7, wherein the defined position is a nearest speaker position of a set of speaker positions.

9. The method as claimed in claim 8, wherein the set of speaker positions in polar co-ordinates are $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

10. The method as claimed in claim 7, wherein processing the at least one of the at least two object orientated audio signal channels based on the order of the at least two object orientated audio signal channels comprises:

selecting a first set of the at least two object orientated audio signal channels, the first set of the at least two object orientated audio signal channels being the lower perceptually ordered channels;

downmixing the first set of the at least two object orientated audio signal channels to a downmixed channel representation; and outputting the downmixed channel representation with the remainder of the at least two object orientated audio signal channels.

11. The method as claimed in claim 7, wherein processing the at least one of the at least two object orientated audio signal channels based on the order of the at least two object orientated audio signal channels comprises:

selecting for parts of the at least two object orientated audio signal channels a highest perceptually ordered channel part;

combining the selected highest perceptually ordered part to generate a first audio signal;

attenuating the at least two object orientated audio signal channels highest perceptually ordered channel part;

combining the attenuated at least two object orientated audio signal channels highest perceptually ordered channel part to the remainder at least two object orientated audio signal channel parts to generate a second audio signal; and outputting the first audio signal and the second audio signal.

12. The method as claimed in claim 11 wherein the parts are frequency sub-bands and/or bands of time periods of the at least two object orientated audio signal channels.

13. A computer program product comprising a non-transitory computer-readable medium bearing computer program code embodied therein, the computer program code configured to cause an apparatus at least to perform:

determining a perception value for each of at least two object orientated signal channels by determining, for each of the at least two object orientated signal channels, a perception value of an object orientated signal channel of the at least two object orientated signal channels based at least in part on an angular distance for the object orientated signal channel to a defined position;

perceptually ordering the at least two object orientated audio signal channels based on the perception value for each of the at least two object orientated audio signal channels; and processing at least one of the at least two object orientated audio signal channels based at least in part on the order of the at least two object orientated audio signal channels.

14. The computer program product as claimed in claim 13, wherein the defined position is a nearest speaker position of a set of speaker positions.

15. The computer program product as claimed in claim 14, wherein the set of speaker positions in polar co-ordinates are $L=[L_r, L_\theta, L_\phi]=[1, -30, 0]$, $R=[R_r, R_\theta, R_\phi]=[1, 30, 0]$, $C=[C_r, C_\theta, C_\phi]=[1, 0, 0]$, $Ls=[Ls_r, Ls_\theta, Ls_\phi]=[1, -110, 0]$, and $Rs=[Rs_r, Rs_\theta, Rs_\phi]=[1, 110, 0]$.

16. The computer program product as claimed in claim 13, wherein the computer program code configured to cause the apparatus at least to perform processing the at least one of the at least two object orientated audio signal channels based on the order of the at least two object orientated audio signal channels further causes the apparatus to perform:

selecting a first set of the at least two object orientated audio signal channels, the first set of the at least two object orientated audio signal channels being the lower perceptually ordered channels;

downmixing the first set of the at least two object orientated audio signal channels to a downmixed channel representation; and outputting the downmixed channel representation with the remainder of the at least two object orientated audio signal channels.

17. The computer program product as claimed in claim 13, wherein the computer program code configured to cause an apparatus at least to perform processing the at least one of the at least two object orientated audio signal channels based on the order of the at least two object orientated audio signal channels further causes the apparatus to perform:

selecting for parts of the at least two object orientated audio signal channels a highest perceptually ordered channel part;

combining the selected highest perceptually ordered part to generate a first audio signal;

attenuating the at least two object orientated audio signal channels highest perceptually ordered channel part;

combining the attenuated at least two object orientated audio signal channels highest perceptually ordered channel part to the remainder at least two object orientated audio signal channel parts to generate a second audio signal; and outputting the first audio signal and the second audio signal.

18. The computer program product as claimed in claim 17 wherein the parts are frequency sub-bands and/or bands of time periods of the at least two object orientated audio signal channels.

* * * * *